United States Patent [19]

Tanikawa et al.

[11] Patent Number: 4,561,911

[45] Date of Patent: Dec. 31, 1985

[54] AQUEOUS SOLUTION FOR COOLING COLD-ROLLED STEEL STRIP IN A CONTINUOUS ANNEALING PROCESS

[75] Inventors: Keiichi Tanikawa, Kanagawa; Masahiro Fujii; Hideo Kanno, both of Fukuoka, all of Japan

[73] Assignee: Nippon Steel Corporation, Tokyo, Japan

[21] Appl. No.: 645,764

[22] Filed: Aug. 30, 1984

[30] Foreign Application Priority Data

Sep. 2, 1983 [JP] Japan ..... 58-160262

[51] Int. Cl.[4] ..... C21D 1/56; C22C 38/00

[52] U.S. Cl. ..... 148/18; 148/28; 148/36

[58] Field of Search ..... 148/18, 28, 36

[56] References Cited

U.S. PATENT DOCUMENTS

| | | | |
|---|---|---|---|
| 913,657 | 2/1909 | Hayes | 148/28 |
| 3,072,506 | 1/1963 | Kopietz | 148/28 |

*Primary Examiner*—Veronica O'Keefe

*Attorney, Agent, or Firm*—Cushman, Darby & Cushman

[57] ABSTRACT

Cooling water containing an α-amino acid suitable for cooling steel strips during their continuous annealing and after their overageing treatment. As the α-amino acid, aliphatic amino acids, aromatic amino acids, heterocyclic amino acids and their hydrochlorides and acetates are used.

17 Claims, No Drawings

AQUEOUS SOLUTION FOR COOLING COLD-ROLLED STEEL STRIP IN A CONTINUOUS ANNEALING PROCESS

BACKGROUND OF THE INVENTION

1. Field of the Invention

The present invention relates to cooling water used in a continuous annealing process of cold-rolled steel strips and the like.

2. Description of the Prior Arts

As a method for preventing the formation of oxide film on the surface of steel strips in the course of this continuous annealing process, it has been known to add what is generally called, organic acids, to cooling water used in water quenching.

The organic acids used for the above purpose in the prior arts include: unbranched chain fatty acids, such as formic acid, acetic acid, propionic acid, oxalic acid, and succinic acid; oxyacids such as citric acid, lactic acid, gluconic acid and tartaric acid; and nitrilotriacetic acid, ethylenediaminetetraacetic acid.2 sodium, as disclosed in Japanese Patent Publication No. Sho 57-47738. Among the above acids, nitrilotriacetic acid and ethylenediaminetetraacetic acid belong to the family of aminopolycarboxylic acids, not to the group of amino acids, and have a completely different chemical nature from amino acids.

Also Japanese Laid-Open Patent Specification No. Sho 57-85923 discloses cooling agents for metals composed of water-soluble organic acid and water-soluble organic amine, and as preferred, water-soluble organic acid, specifies water-soluble dicarboxylic acids having three or more carbon atoms, such as saturated dicarboxylic acids including malonic acid, succinic acid, glutaric acid, adipic acid, and pimelic acid; non-saturated dicarboxylic acids, such as maleic acid, itaconic acid; and hydroxycarboxylic acids, such as malic acid and tartaric acid.

Further, Japanese Laid-Open Patent Application No. Sho 58-55533 discloses a quenching process with use of an aqueous solution containing organic acids, such as malonic acid, formic acid, citric acid, acetic acid, lactic acid, succinic acid and tartaric acid.

All of the various organic acids disclosed in the prior art publications have been found to be not satisfactory; some are not satisfactorilly effective to prevent the formation of oxide film, and others make the removal of oxide film difficult, depending on the temperature of the solution or on the temperature of the cold-rolled steel strip after cooling.

SUMMARY OF THE INVENTION

One of the objects of the present invention is to obtain steel strips having excellent surface cleanliness by use of α-amino-acid-containing water for water spray cooling or gas-water spray cooling in the primary cooling of cold-rolled steel strips after recrystallization soaking and in the secondary cooling after overageing.

For this object, the present invention provides an aqueous solution containing an α-amino acid to be used as cooling water in the primary and/or secondary cooling steps in a continuous annealing process of a cold-rolled steel strip, including recrystallization soaking, primary cooling, overageing and secondary cooling.

The α-amino-acid-containing cooling water according to the present invention is effective to prevent the oxide film formation in the course of the recrystallization as well as the oxide film formation during the primary gas-water spray cooling and/or the secondary similar cooling after the overageing treatment.

DETAILED DESCRIPTION OF THE INVENTION

The term "amino acid" used in the present invention is a general term for compounds having an amino group ($-NH_2$) and a carboxyl group ($-COOH$) in their molecules and the term "α-amino acid" means an amino acid in which the amino group is attached to the carbon atom (α-carbon) bonded to the carboxyl group. The amino acid is a constituent of protein, and different from organic acids as generally accepted.

Contrary to other organic acids amino acids react with iron to temporarily form an aqueous solution of amino acid iron, which, along the lapse of time, changes into iron hydroxide, liberating the amino acids. The liberated amino acid can be recovered and reused.

The α-amino acid used in the present invention includes:

I. Aliphatic amino acids:
   (A) Neutral amino acids
   (B) Basic amino acids
   (C) Acidic amino acids and their amid
   (D) Sulphur-containing amino acids
II. Aromatic amino acids
III. Heterocyclic amino acid, and their accetates or nitrates hydrochloride These amino acids are used in the form of a neutral salt such as an amine salt and ammonium salt, or in the form of a neutral aqueous solution in amine or ammonia.

For illustration, aliphatic amino acids include alanine, arginine, arginine hydrochloride, asparagine, aspartic acid, tyrosine, cysteine hydrochloride, cystine, glutamine, glutamic acid, sodium glutamate, glycine, leucine, iso-leucine, lysine, lysine hydrochloride and lysine acetate; the aromatic amino acids include phenylalanine and tyrosine; and the heterocyclic amino acids include proline, histidine, hydroxyproline and tryptophane.

Among the above compounds, the acidic amino acids such as aspartic acid and glutamic acid, when dissolved in water, become acidic (the aqueous solution of aspartic acid shows pH of 2.7 and that of glutamic acid shows pH of 3.2). Therefore, it is desirable to use these acids in the form of a neutral salt or to neutralize the solution so as to have a pH value from 6 to 8, in order to prevent their causing corrosion of the treating equipment.

In the water quenching step after heat treatment in a continuous annealing process of a cold-roller steel strip, it has been found difficult to prevent the surface oxide film formation even if gas-water spray cooling is performed using an inert gas such as nitrogen gas, because the steel surface is oxidized by water vapor which is generated during the gas-water spray cooling. In this case, it has been found that when an aqueous solution containing 0.1–20% by weight α-amino acid, instead of simple water, is used, it is possible to obtain a cold-rolled steel strip having an excellent surface cleanliness and surface condition very favorable for the subsequent chemical conversion treatments.

The lower limit of α-amino acid added to the cooling water may be determined by its effect, while there is no specific upper limit from the technical view, but economically about 20% is preferred. From a practical point of view it is preferable to maintain the content of α-amino acid in a range from 0.1 to 5%.

Also, in order to improve the wetting characteristic of the α-amino acid aqueous solution when applied on the strip surface, 0.001 to 0.5% of a surfactant may be added to the solution. Preferable surfactants for this purpose are amino acid derivatives in particular, such as lauroyl or palmitoyl glutamic acid and palmitoyl-L-lysine ethylester hydrochloride.

DESCRIPTION OF THE PREFERRED EMBODIMENTS

The present invention will be better understood from the following embodiments.

Example 1

Cold-rolled steel strips (SPC:-0.01% C, 0.3% Mn, 0.01% Si, 0.005% S, 0.01% P, 0.003% N, 0.02% Al, balance being iron-; 35 mm, wide 130 mm long and 1.2 mm thick) were subjected to annealing and gas-water spray cooling tests according to the successive procedures (1) through (4) and under the conditions as set forth below.

(1) The strips were subjected to recrystallization soaking at 750° C. in a mixed gas atmosphere of nitrogen (98%) and hydrogen (2%).

(2) The strips thus heat treated were subjected to a primary gas-water spray cooling from 750° to 400° C. at a cooling rate of 100° C./sec., using water containing α-amino acid and nitrogen gas.

(3) The strips thus cooled were subsequently subjected to an overageing treatment in a mixed gas atmosphere of nitrogen (98%) and hydrogen (2%) at 400° C.

(4) The strips, overaged at 400° C., were cooled in the same atmosphere to 300° C., subjected to a secondary cooling to 50° C. with gas-water spray of α-amino acid solution and nitrogen gas, and then taken out of the atmosphere, washed with water and dried.

The flow density of the cooling water used in the primary and secondary cooling steps is 100 $m^3/m^2min$.

Results of the above tests are shown in Tables 1 and 2. The results shown in Table 1 were obtained by using cooling water containing the same content of α-amino acid in both the primary cooling in the heat treatment and the secondary cooling after the overageing.

The results shown in Table 2 were obtained by using cooling water which contained a different content of α-amino acid in the primary cooling, from that used in the secondary cooling step.

The thickness of oxide films shown in the tables was calculated from the weight different measured before and after the acid pickling, and by using the average gravity 5.4 of FeO, (5.9), $Fe_2O_3$ (5.1) and $Fe_3O_4$ (5.2). The acid pickling was conducted in 5% hydrochloric acid aqueous solution plus 0.5% of an inhibitor.

Example 2

Cold-rolled steel strips (SPC of the same composition as in Example 1: 35 mm wide, 130 mm long and 1.2 mm thick) were subjected to heat treatments and water cooling tests according to the following successive procedures (1) through (4).

(1) The strips were heated for recrystallization at 750° C. in a mixed gas atmosphere of nitrogen (98%) and hydrogen (2%).

(2) The strips thus heat treated were subjected to a primary cooling by immersion in water containing α-amino acid.

(3) The strips after the primary cooling were subjected to an overageing treatment in a nitrogen (98%) and hydrogen (2%) gas atmosphere at 400° C.

(4) The strips overaged were subjected to a secondary cooling from 400° C. to 50° C. by immersion in water containing α-amino acid, taken out of the atmosphere, washed with water and dried.

The results of the above tests are shown in Tables 3 and 4. The results shown in Table 3 were obtained by using cooling water containing the same amount of α-amino acid in both the primary cooling in the heat treatment and the secondary cooling after the overageing.

The results shown in Table 4 were obtained by using cooling water of a different content of α-amino acid in the primary and secondary cooling steps. The thickness of oxide films was calculated on the same basis as in Example 1.

Example 3

Cold-rolled steel strips (SPC of the same composition as in Example 1; 35 mm wide, 130 mm long and 1.2 mm thick) were subjected to annealing and gas-water cooling tests in the same procedures as in Example 1. The test results obtained by using neutral salts of α-amino acid or neutral aqueous solution thereof in the cooling water are shown in Tables 5 and 6.

The results shown in Table 5 were obtained by using cooling water having the same concentration in both the primary cooling in the heat treatment and the secondary cooling after the overageing.

The results shown in Table 6 were obtained by using cooling water having a different concentration in the primary cooling from that used in the secondary cooling. The thickness of oxide films shown in the table was calculated on the same basis as in Example 1.

Example 4

Cold-rolled steel strip (SPC of the same composition as in Example 1; 35 mm wide, 130 mm long and 1.2 mm thick) were subjected to annealing and water cooling tests according to the same procedures as in Example 2.

The test results of cooling the sheets by immersion in neutral salts or neutral aqueous solutions of α-amino acid are shown in Tables 7 and 8. The results shown in Table 7 were obtained by using cooling water of the same concentration of α-amino acid in both the primary cooling in the heat treatment and in the secondary cooling after overageing.

The results shown in Table 8 were obtained by using cooling water having a different concentration of α-amino acid in the primary cooling from that used in the secondary cooling.

The thickness of oxide films shown in the tables were calculated on the same basis as in Example 1.

Example 5

Cold-rolled steel strip for deep drawing (0.03% C, 0.15% Mn, 0.01% Si, 0.01% P, 0.005% S, 0.003% N, 0.03% Al, 0.03% Ti, balance being iron; 35 mm wide, 130 mm long and 1.2 mm thick) were subjected to annealing and water quenching tests according to the following procedures (1) and (2):

(1) The strips were subjected to recrystallization heating at 750° C. in a mixed gas atmosphere of nitrogen (98%) and hydrogen (2%).

(2) The strips thus heat treated were subjected to cooling by immersion in α-amino-acid-containing water, taken out of the atmosphere, washed with water and dried.

The results of the immersion cooling tests are shown in Table 9.

The thickness of oxide films shown in Table 9 was calculated on the same basis as in Example 1.

Example 6

High-strength cold-rolled steel strips (0.05% C, 1.3% Mn, 0.01% Si, 0.005% S, 0.01% P, 0.003% N, 0.03% Al, balance being iron; 35 mm wide, 130 mm long and 1.2 mm thick) were subjected to annealing and water cooling tests according to the following procedures (1) and (2):

(1) The strips were subjected to recrystallization heating at 800° C. in a mixed gas atmosphere of nitrogen (98%) and hydrogen (2%).

(2) The strips thus heat treated were subjected to cooling by immersion in α-amino-acid-containing water, taken out of the atmosphere, washed with water and dried.

The results of the immersion cooling tests are shown in Table 10.

The thickness of oxide films in Table 10 was calculated on the same basis as in Example 1.

TABLE 1

| Example No. | α-amino acid aqueous solution | pH | Appearance | Oxide film (Å) |
|---|---|---|---|---|
| 1 | Glycine 1% | 5.97 | Good | 40 |
| 2 | Valine 0.5% | 5.96 | " | 34 |
| 3 | Lysine hydrochloride 0.5% | 5.2 | " | 30 |
| 4 | Citrullin 0.25% | 5.74 | " | 50 |
| 5 | Alanine 1% | 5.48 | " | 35 |
| 6 | Arginine hydrochloride 1% | 6.30 | " | 30 |
| 7 | Glutamine 1% | 5.65 | " | 38 |
| Comparative | Water | | Light yellow | 170 |

TABLE 2

| Example No. | α-amino acid aqueous solution: primary cooling/secondary cooling | Appearance | Oxide film (Å) |
|---|---|---|---|
| 1 | Glycine 0.25%/1% | Good | 32 |
| 2 | Lysine 0.1%/1.5% | " | 35 |
| 3 | Alginine hydrochloride 0.2%/0.5% | " | 30 |
| 4 | Alanine 0.25%/0.5% | " | 40 |
| 5 | Glutamine 0.1%/3% | " | 30 |

TABLE 2-continued

| Example No. | α-amino acid aqueous solution: primary cooling/secondary cooling | Appearance | Oxide film (Å) |
|---|---|---|---|
| 6 | Lysine 0.1%/1.5% + Surfactant: lysineethylesterhydrochloride 0.05% | " | 34 |
| Comparative | Water | Light yellow | 170 |

TABLE 3

| Example No. | α-amino acid aqueous solution | pH | Appearance | Oxide film (Å) |
|---|---|---|---|---|
| 1 | Alanine 1% | 6.0 | Good | 28 |
| 2 | Asparagine 0.5% | 5.41 | " | 35 |
| 3 | Argininehydrochloride 0.75% | 5.7 | " | 40 |
| 4 | Citrullin 0.5% | 5.96 | " | 35 |
| 5 | Tyrosine 1% | 5.65 | " | 30 |
| Comparative | Water | 6.50 | Light yellow | 186 |

TABLE 4

| Example No. | α-amino acid aqueous solution: primary cooling/secondary cooling | Appearance | Oxide film (Å) |
|---|---|---|---|
| 1 | Alanine 0.5%/0.75% | Good | 32 |
| 2 | Argininehydrochloride 0.25%/0.5% | " | 40 |
| 3 | Citrullin 0.2%/1.5% | " | 35 |
| 4 | Glutamine 0.3%/Glycine 0.5% | " | 35 |
| Comparative | Water | Light yellow | 186 |

TABLE 5

| Example No. | α-amino acid aqueous solution | pH | Appearance | Oxide film (Å) |
|---|---|---|---|---|
| 1 | Triethanolamine glutamate 0.3% | 6.1 | Good | 35 |
| 2 | Monoethanolamine glutamate 3% | 8.0 | " | 30 |
| 3 | Ammonium glutamate 1% | 6.5 | " | 30 |
| 4 | Triethanolamine aspartate 0.5% | 7.0 | " | 40 |
| 5 | Ammonium aspartate 5% | 6.3 | " | 38 |
| 6 | Valine 0.1% (triethanolamine added) | 7.5 | " | 42 |
| Comparative | Water | 6.5 | Light yellow | 174 |

TABLE 6

| Example No. | α-amino acid aqueous solution: primary cooling/secondary cooling | pH: primary cooling/secondary cooling | Appearance | Oxide film (Å) |
|---|---|---|---|---|
| 1 | Diethanolamine glutamate 0.3%/1% | 6.6/6.4 | Good | 34 |
| 2 | Ammonium glutamate 0.2%/1.5% | 7.2/7.0 | " | 31 |
| 3 | Triethanolamine aspartate 1%/0.5% | 8.0/8.0 | " | 38 |
| 4 | Ammonium aspartate 0.2%/3% | 7.5/7.2 | " | 30 |
| 5 | Alanine 0.2%/0.5% (monoethanolamine added) | 5.5/8.0 | " | 40 |
| 6 | Valine 0.5%/1% (ammonic liquor added) | 6.0/7.3 | " | 35 |
| 7 | Glycine 1%/0.2% (triethanolamine added) + surfactant polyoxyethylenealkylether 0.04% | 5.97/7.0 | " | 35 |
| Comparative | Water | 6.5 | Light yellow | 175 |

TABLE 7

| Example No. | α-amino acid aqueous solution | pH | Appearance | Oxide Film (Å) |
|---|---|---|---|---|
| 1 | Triethanolamine aspartate 0.5% | 7.2 | Good | 40 |
| 2 | Monoethanolamine aspartate 2% | 6.0 | " | 30 |
| 3 | Ammonium aspartate 5% | 6.5 | " | 35 |
| 4 | Triethanolamine glutamate 1% | 7.0 | " | 32 |
| 5 | Ammonium glutamate 3% | 6.2 | " | 38 |
| 6 | Alanine (triethanolamine added) 0.5% | 8.0 | " | 35 |
| Comparative | Water | 6.5 | Light yellow | 180 |

TABLE 8

| Example No. | α-amino acid aqueous solution: primary cooling/secondary cooling | pH: primary cooling/ secondary cooling | Appearance | Oxide film (Å) |
|---|---|---|---|---|
| 1 | Triethanolamine aspartate 1%/0.3% | 7.3/7.4 | Good | 30 |
| 2 | Ammonium aspartate 0.5%/5% | 6.7/6.7 | " | 32 |
| 3 | Triethanolamine glutamate 1%/0.2% | 6.0/6.2 | " | 40 |
| 4 | Ammonium glutamate 0.3%/0.5% | 7.5/7.4 | " | 40 |
| 5 | Alanine 0.1%/Valine 0.5% (triethanolamine added in both) | 8.0/8.0 | " | 35 |
| Comparative | Water | 6.5 | Light yellow | 185 |

TABLE 9

| Example No. | α-amino acid aqueous solution | pH | Appearance | Oxide film (Å) |
|---|---|---|---|---|
| 1 | Valine 1% | 5.95 | Good | 42 |
| 2 | Triethanolamine glutamate 1% | 7.0 | " | 38 |
| 3 | Alanine 2% | 5.50 | " | 40 |
| Comparative | Water | | Light yellow | 180 |

TABLE 10

| Example No. | α-amino acid aqueous solution | pH | Appearance | Oxide film (Å) |
|---|---|---|---|---|
| 1 | Glycine 1% | 5.97 | Good | 42 |
| 2 | Lysine hydrochloride 0.5% | 5.20 | " | 48 |
| 3 | Triethanolamine aspartate 2% | 7.5 | " | 38 |
| Comparative | Water | | Light yellow | 180 |

What we claim:

1. A process for cooling cold-rolled steel strips in a continuous annealing process comprising applying to the steel strips an aqueous solution of an α-amino acid or a salt of an α-amino acid.

2. A process according to claim 1, in which the α-amino acid or salt is one selected from a group consisting of aliphatic amino acids, aromatic amino acids, heterocyclic amino acids and their hydrochlorides and acetates.

3. A process according to claim 1, in which the amount of α-amino acid or salt is 0.1–20% by weight.

4. A process according to claim 1, in which the α-amino acid is one selected from the group consisting of glycine, valine, lysine hydrochloride, citrulline, alanine, arginine acetate, arginine hydrochloride, glutamine, asparagine, tyrosine, monoethanolamine glutamate, diethanolamine glutamate, triethanolamine glutamate, ammonium glutamate, triethanolamine aspartate and ammonium aspartate.

5. A process according to claim 1, wherein the aqueous solution further comprises a surfactant.

6. A process according to claim 1, in which the aqueous solution is controlled in a pH range from 6.0 to 8.0.

7. Cold-rolled steel strip obtained by cooling the steel strip with an aqueous solution of an α-amino acid or cooling with an aqueous solution of a salt of an α-amino acid during a cooling step in a continuous annealing process.

8. Cold-rolled steel strip obtained by recrystallization annealing, treating and cooling thereafter with an aqueous solution of an α-amino acid or an aqueous solution of a salt of an α-amino acid.

9. A process according to claim 1 wherein the α-amino acid or salt thereof is glycine, valine, citrulline, alanine, arginine, glutamine, asparagine, aspartic acid, glutamic acid, cysteine, cystine, leucine, isoleucine, lysine, phenylalanine, proline, histidine, hydroxy proline or tryptophane or a neutral salt of such amino acid.

10. A process according to claim 2 wherein the aqueous solution consists essentially of a water and the α-amino acid or salt thereof.

11. A process according to claim 3 wherein the aqueous solution consists essentially of a water and the α-amino acid or salt thereof.

12. A process according to claim 4 wherein the aqueous solution consists essentially of a water and the α-amino acid or salt thereof.

13. A process according to claim 5 wherein the aqueous solution consists essentially of a water and the α-amino acid or salt thereof.

14. A process according to claim 6 wherein the aqueous solution consists essentially of a water and the α-amino acid or salt thereof.

15. A process according to claim 1 wherein the aqueous solution consists essentially of a water and the α-amino acid or salt thereof.

16. Cold-rolled steel according to claim 7 wherein the aqueous solution consists essentially of a water and the α-amino acid or salt thereof.

17. Cold-rolled steel according to claim 8 wherein the aqueous solution consists essentially of a water and the α-amino acid or salt thereof.

* * * * *